US006878352B1

(12) United States Patent
Fukabori et al.

(10) Patent No.: US 6,878,352 B1
(45) Date of Patent: Apr. 12, 2005

(54) INFLATOR PROCESSING APPARATUS AND METHOD OF JUDGING CHARGE OF INFLATOR

(75) Inventors: Mitsuhiko Fukabori, Hyogo (JP); Nobuo Nakabayashi, Osaka (JP); Kanshi Sakai, Toyota (JP); Yasumitsu Suzuki, Toyota (JP); Norio Yoshitake, Kitakyushu (JP); Masato Fujioka, Kitakyushu (JP)

(73) Assignee: Daicel Chemical Industries, Ltd., Sakai (JP)

( * ) Notice: Subject to any disclaimer, the term of this patent is extended or adjusted under 35 U.S.C. 154(b) by 0 days.

(21) Appl. No.: 09/509,571

(22) PCT Filed: Sep. 29, 1998

(86) PCT No.: PCT/JP98/04366

§ 371 (c)(1),
(2), (4) Date: Jun. 14, 2000

(87) PCT Pub. No.: WO99/16641

PCT Pub. Date: Apr. 8, 1999

(30) Foreign Application Priority Data

Sep. 29, 1997 (JP) ..... 9-264574

(51) Int. Cl.[7] ..... F23G 7/00; B09B 3/00

(52) U.S. Cl. ..... 422/198; 422/108; 422/110; 422/184.1; 110/237; 110/326; 110/346; 588/202; 588/900

(58) Field of Search ..... 422/105, 108, 422/110–112, 164–165, 184.1, 198; 110/237, 326, 346; 432/159, 120, 186, 248; 588/202, 900

(56) References Cited

U.S. PATENT DOCUMENTS 3,793,101 A * 2/1974 Mullarkey ..... 102/205
3,903,814 A * 9/1975 Altekruse ..... 110/237
5,062,372 A * 11/1991 Ritter ..... 110/242
5,294,244 A * 3/1994 Allerton, III et al. ..... 75/401

FOREIGN PATENT DOCUMENTS

| | | |
|---|---|---|
| EP | 0 677 336 A1 | 10/1995 |
| JP | 63-259315 A | 10/1988 |
| JP | 63-282416 A | 11/1988 |
| WO | WO 96/14173 | 5/1996 |
| WO | WO 97/21058 | 6/1997 |

OTHER PUBLICATIONS

Patent Abstracts of Japan, Feb. 3, 1984, vol. 8, No. 26 (M–273), abstract of JP Publication No. 58184420, publication date Oct. 27, 1983.

* cited by examiner

*Primary Examiner*—Hien Tran
*Assistant Examiner*—Jennifer Leung
(74) *Attorney, Agent, or Firm*—Birch, Stewart, Kolasch & Birch, LLP

(57) ABSTRACT

Recovery of air bag inflator metal cases. An inflator processing apparatus configured to process a gas-generating chemical-containing inflator for automobile air bags, by heating the inflator to a temperature not lower than an operating temperature of the chemical to facilitate recovery of the metal inflator case. In the apparatus, a protective metal partition wall is provided between an inner surface of a wall of an inflator-processing furnace and the chemical-containing inflator. This prevents damage to the refractory furnace wall, and also prevents melting of the metal inflator case, which could otherwise be occasioned by the chemical during thermal processing of the inflator containing the gas-generating chemical.

3 Claims, 3 Drawing Sheets

INFLATOR PROCESSING APPARATUS AND METHOD OF JUDGING CHARGE OF INFLATOR

This application is the national phase under 35 U.S.C. § 371 of PCT International Application No. PCT/JP98/04366 which has an International filing date of Sep. 29, 1998, which designated the United States of America.

TECHNICAL FIELD

The present invention relates to an inflator processing apparatus adapted to process a gas generating chemical-containing inflator for an air bag of an automobile by heating the inflator to a temperature not lower than an operating temperature of the chemical and recover a metal case therefor, and to a method of judging the timing of charge of the inflator.

In the figures;

1: inflators;

2: processing furnace;

3: incinerator;

4, 4*a* and 4*b*: furnace wall;

5: sealing valve;

6: charge pusher;

7: charger;

8*a*, 8*b* and 8*c*: partition wall;

9: processing gas supply port;

10: residue discharge port;

11: exhaust tube;

12: burner;

13: air supplier for dilution;

14: waste incinerator;

15: inflator charge port;

16: pressure sensor;

17: peak counter;

20: hopper.

BACKGROUND OF THE INVENTION

Installation of air bags has been already made compulsory by laws in U.S. and other countries as safety systems for mitigating impacts on human bodies in case of collisions of automobiles. In Japan, too, there is a high possibility that the installation is made compulsory by laws in the near future.

An inflator is an inflating device for such an air bag. A chemical contained in the inflator is operated by impact occurring at the time of a collision (for example, $2NaN_3+CuO \rightarrow Na_2O+Cu+3N_2$), thereby generating an $N_2$ gas by which the air bag is instantly inflated to protect a passenger (s).

Also, in Japan, new cars equipped with air bags have been recently increasing in number. Since, when those cars equipped with air bags are disposed, a large number of chemical-containing inflators will be generated, it is necessary to operate and process the chemical safely and recover a metal case of the inflator from the standpoints of safety and effective utilization of resources.

Figure 3:
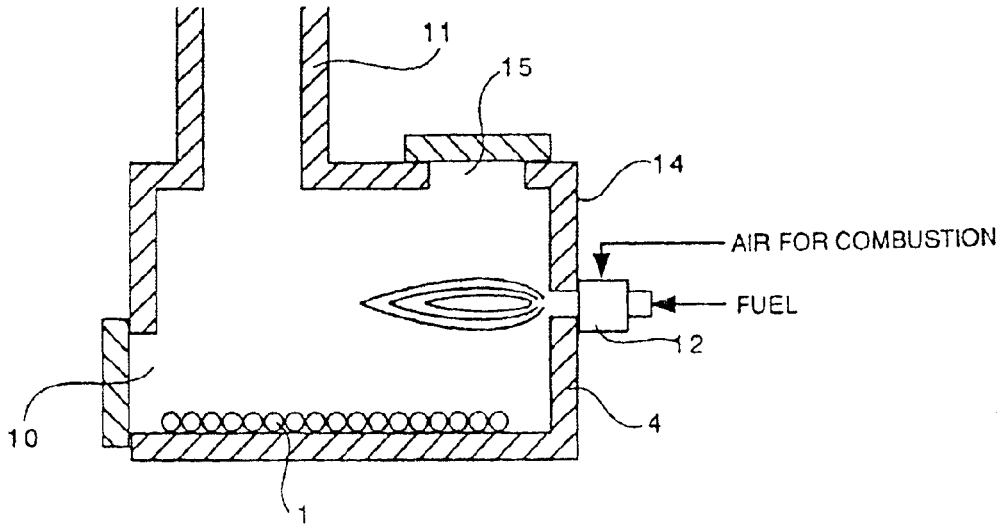
Fig. 3 Conventional Art
FIG. 3 is a longitudinal section illustrating an example of inflator processing by a conventional waste incinerator.

However, since, in recent years, those air bags have started to be installed in automobiles, established processing techniques are not available, and it is the present state that experiments are being conducted to search for a processing method, for example, using a conventional waste incinerator 14, as shown in FIG. 3. This waste incinerator 14 includes a furnace shell formed by a furnace wall 4, an inflator charge port 15 for charging inflators 1 into the incinerator 14, a burner 12 for heating and processing the charged inflators 1, a residue discharge port 10 for discharging the processed inflators 1, and an exhaust tube 11 for evacuating the interior of the incinerator.

Generally, an inflator for an air bag contains a gas generating chemical in a metal case made of stainless steel or aluminum. While a size of the inflator is slightly different between one for a driver's and one for a passenger's side, the rough size of metal cases is approximately from $\phi 50 \times H200$ mm to $\phi 100 \times H50$ mm. The operating temperature of the chemical is normally approximately from 300 to 600° C., though it varies depending upon the presence or absence of an igniter.

However, in case where the chemical-containing inflator is processed in the conventional waste incinerator, there were the following problems:

(1) Operation of the chemical splashes the inflator or its fragments, thereby damaging a furnace wall refractory of the waste incinerator or the burner.

(2) Since the burner is directly provided on the waste incinerator, the temperature distribution inside the furnace is made non-uniform by influence of a high-temperature flame, whereby the heating time of the inflator, i.e., the operating time of the chemical, becomes irregular; during a charge work of the inflator, an operation of the chemical occurs; and, in addition, the metal case of the inflator is melted.

DISCLOSURE OF THE INVENTION

This invention has been made to solve the foregoing problems, and its object is to provide an inflator processing apparatus adapted to prevent damage to a furnace wall refractory of an inflator and the melting of a metal case for the inflator during an operation of a chemical in the thermal processing of the inflator containing the gas generating chemical as well as to provide a method of judging the timing of charge of the inflator.

In order to solve the foregoing problems, the gist of this invention lies:

(1) An inflator processing apparatus adapted to process a gas generating chemical-containing inflator for an air bag of an automobile by heating the inflator to a temperature not lower than an operating temperature of the chemical and recover a metal case therefor, wherein a metal partition wall is provided between an inner surface of a wall of a processing furnace for processing the inflator and the inflator so as to cover the inner surface of the furnace wall;

(2) An incinerator provided with a burner and an air supplier for dilution and/or an exhaust gas circulator is connected with the processing furnace; and (3) The timing of charge of the inflator is judged by comparing the number of charged inflators with the number of peak points of furnace pressure during an operation of the chemical.

[Function]

In the inflator processing apparatus and the method of judging charge of inflators in accordance with this invention, since the metal partition wall is provided between the inner surface of the wall of the processing furnace and the inflator so as to cover the inner surface of the furnace wall, the inflator or its fragments splashed by the operation of the chemical collide against the metal partition wall and drop on a floor of the furnace, so that the furnace wall refractory is not damaged.

Further, since a high-temperature flame is generated in the incinerator connected with the processing furnace of the inflator and mixed with an ordinary-temperature air for dilution or/and a low-temperature exhaust gas to obtain a processing gas temperature slightly higher than the operating temperature of the chemical, and uniform and soft heating of the inflator is carried out by this processing gas, not only the heating time necessary for the processing of the operation of the inflator becomes constant, but also the melting of the metal case of the inflator and high-temperature oxidation of the metal partition wall of the processing furnace due to the processing gas are prevented.

Additionally, since the timing of charge of the inflator is judged by comparing the number of charged inflators with the number of peaks of furnace pressure during the operation of the chemical, during charge of the inflator, ejection of the gas generated in the furnace due to the operation of the inflator is prevented.

FORM TO CARRY OUT THE INVENTION

An embodiment of the present invention is hereinafter described with reference to the drawings.

Figure 1:
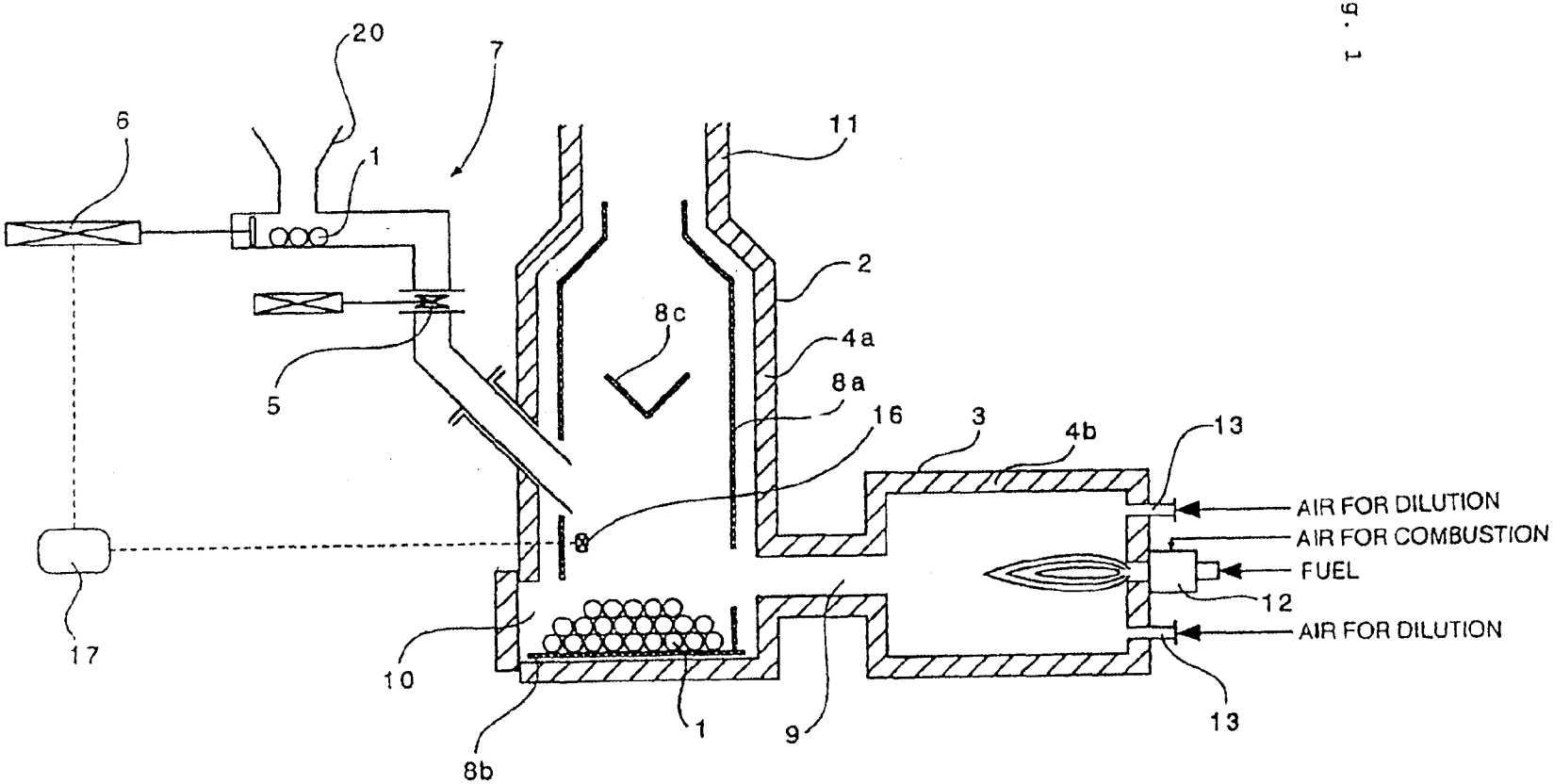
FIG. 1 is a longitudinal section illustrating one example of an inflator processing apparatus in accordance with this invention.

FIG. 1 is a longitudinal section of an inflator processing apparatus illustrating one embodiment of the invention and a conceptual diagram illustrating a method of judging the timing of charge of the inflator.

As shown in FIG. 1, the inflator processing apparatus is constituted by a processing furnace 2 for processing inflators 1 and an incinerator 3 connected together, and shells of the processing furnace 2 and of the incinerator 3 are formed by furnace walls 4*a* and 4*b*, respectively.

Since the furnace walls 4*a* and 4*b* are required to have refractoriness, heat insulation, and hermeticity, the outer shells of the furnace walls 4*a* and 4*b* are normally made of steel skin, and inner surfaces of the steel skin are lined with a refractory material such as castable ceramic fibers.

A charger 7 constituted by a sealing valve 5 and a charge pusher 6 is provided in a side portion of the wall 4*a* of the processing furnace 2, and the inflators 1 are charged intermittently into the processing furnace 2 by the charger 7.

From the standpoint of preventing the ejection of the gas generated in the furnace, it is desired to operate the sealing valve 5 and the charge pusher 6 for a short period of time, and a driving apparatus to be used is generally in a pneumatic driving mode.

Metal partition walls 8*a*, 8*b*, and 8*c* are provided between the inner surface of the inflator 1 charged in the processing furnace 2 and the furnace wall 4*a* of the processing furnace 2. Since the metal partition walls 8*a*, 8*b*, and 8*c* are required to have heat resistance and heat strength, a heat-resisting steel such as SUS310S is usually used.

Further, a processing gas supply port 9 for heating the inflators and a residue discharge port 10 for the inflators 1 are provided in a lower portion of the processing furnace 2 as well as an exhaust tube 11 for the processing gas after heating the inflators is provided in an upper portion thereof.

On the other hand, a burner 12 is aligned in one terminal side of the incinerator 3, and a fuel and an air for combustion are supplied as well as an air for dilution is supplied into the incinerator 3 from an air supplier for dilution 13 provided in an outer portion of the burner 12.

The incinerator 3 and a furnace bottom portion of the processing furnace 2 constructed in this way are connected through the processing gas supply port 9, and a processing gas for heating the inflators 1 is supplied into the processing furnace 2 from the incinerator 3.

Next, the operation and function of the inflator processing apparatus in accordance with this invention will be described, together with a method of judging the timing of charge of the inflators.

A fuel and an air for combustion are supplied into the burner 12 of the incinerator 3 to generate a high-temperature flame, and the temperature of this high-temperature flame is adjusted to a processing gas temperature adapted for the processing temperature of the inflators 1 and slightly higher than the operating temperature of the chemical by the air for dilution from the air supplier for dilution 13, and then blown into the furnace bottom portion of the processing furnace 2 from the processing gas supply port 9.

On the other hand, after opening the sealing valve 5 of the charger 7, the charge pusher 6 is operated to charge the inflators 1 into the processing furnace 2, and immediately thereafter, the sealing valve 5 is closed.

Since the inflators 1 charged in the processing furnace 2 are heated uniformly and softly by a low-temperature processing gas supplied through the processing gas supply port 9, the heating time of the inflators 1 is substantially uniform, and, as a result, the operating time of the chemical is rendered substantially uniform. Also, since the temperature of the processing gas is low, the melting of the metal case of the inflator 1 and high-temperature oxidation of the metal partition walls 8*a*, 8*b*, and 8*c* of the processing furnace 2 are prevented.

Further, since the metal partition walls 8*a*, 8*b*, and 8*c* are provided so as to cover the inner surface of the furnace wall 4*a* of the processing furnace 2, the inflators 1 and their fragments splashed by the operation of the chemical collide directly against the partition walls 8*a*, 8*b*, and 8*c* and drop on the furnace floor so that the furnace wall 4*a* is not damaged. Accordingly, a soft furnace material such as ceramic fibers having good heat responsibility can be used as the furnace wall 4*a*, and it is easy to start up the furnace.

The processing gas after the inflators 1 have been heated is discharged as a low-temperature exhaust gas out of the furnace through the exhaust tube 11.

On the other hand, the residues from the inflators 1 after the heating processing are periodically taken out of the furnace through the residue discharge port 10.

When a large number of inflators 1 are simultaneously charged into the processing furnace 2, the probability of simultaneous operation of the chemical increases, and as a result, the maximum furnace pressure increases, whereby ejection of the gas generated in the furnace through the sealing portion of the furnace body occurs. Thus, for safety, it is necessary to intermittently charge a few of the inflators 1 into the processing furnace 2.

Figure 2:
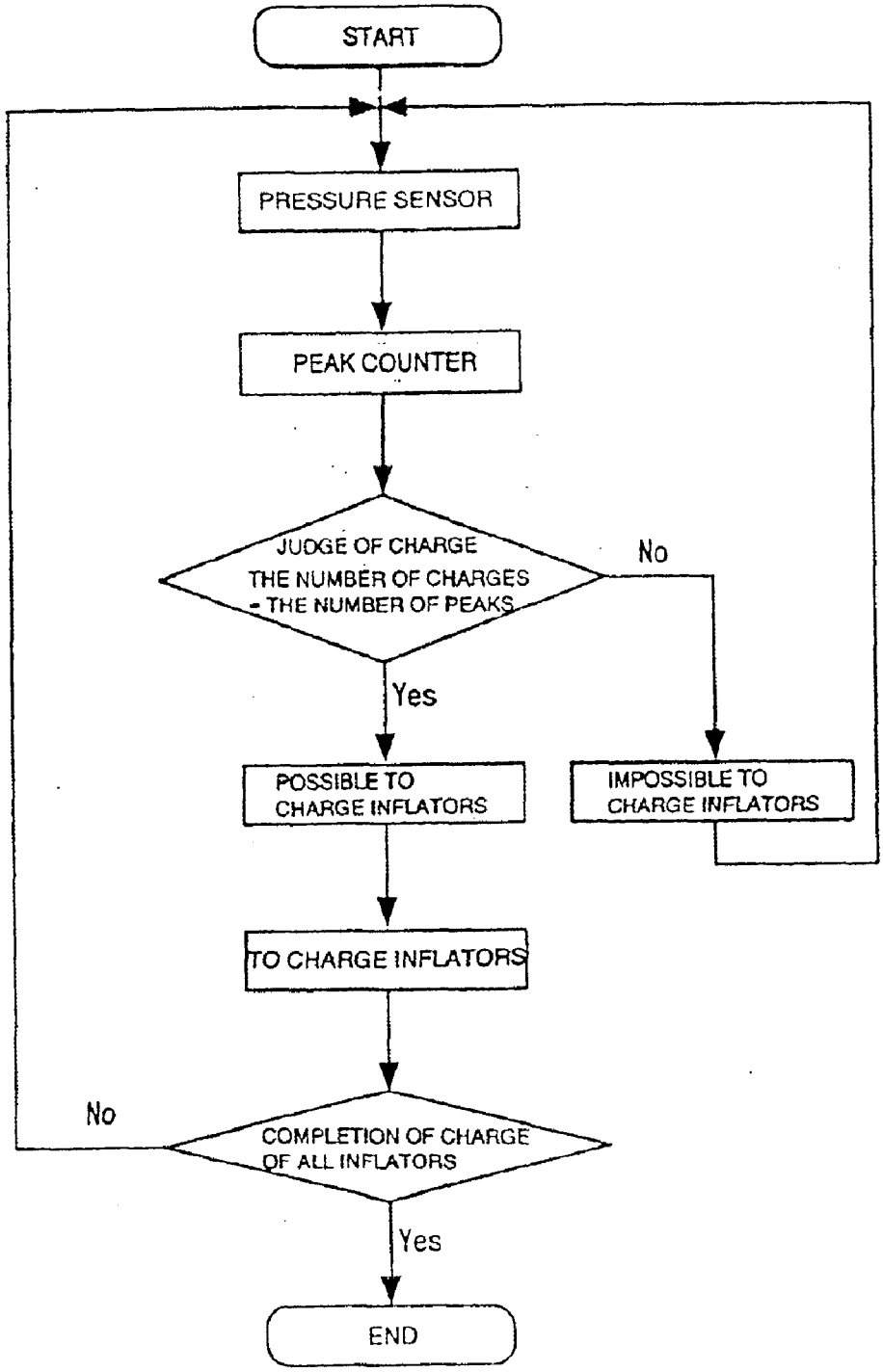
FIG. 2 is a flow chart illustrating a method of judging the timing of charge of inflators.

The timing of intermittent charge of the inflators 1 is determined by the method of judging the timing of charge of the inflators as illustrated in FIG. 2. That is, the number of operations of the chemical is counted with a pressure sensor 16 provided on the processing furnace 2 and with a peak counter 17 for a furnace pressure signal, and only in case where the number of counted peaks of the furnace pressure (i.e., the number of pressure peak points) coincides with the number of charged inflators 1, the next inflators 1 are charged.

As a result, since the chemical is not operated during charge of the inflators, the charging work is safe, and, in addition, an interval of charge of the inflators 1 is a minimum time, thereby maximizing the performance of the processing apparatus.

It is to be understood the present this invention is not limited to the embodiment described above and that, as a matter of course, various changes and modifications can be made therein without departing from the gist of this invention, for example, as given below.

(1) The metal partition walls 8*a* and 8*b* of the processing furnace 2 are fabricated into a hermetic integral structure, and the furnace wall 4*a* made of a refractory such as ceramic fibers is formed directly on the outer portion thereof.

(2) For the adjustment of the temperature of the high-temperature combustion gas generated in the incinerator 3, the exhaust gas from the processing furnace 2 or an air preheated by recovering waste heat from the exhaust gas, thereby reducing the fuel consumption rate.

(3) The furnace bottom portion of the processing furnace 2 is fabricated into a refractory grid structure, and the processing gas is supplied from a lower portion of the refractory grid, thereby promoting heat transfer to the inflators 1.

(4) The inflators 1 are heated by an electric heater provided outside the metal partition walls 8*a*, 8*b*, and 8*c*.

(5) A sealing valve similar to the sealing valve 5 of the charger 7 for the inflators 1 is further provided, for example, inside the hopper 20 to form the double sealing valves, and the pusher 6 is provided between the double sealing valves, thereby preventing ejection of the gas in the furnace during charge of the inflators 1.

(6) The furnace bottom portion of the processing furnace 2 can be replaced with an elevatable furnace floor. The processing residues on the furnace floor, which is lowered down, are automatically discharged by the pusher. By pushing up the furnace floor against the main body of the processing furnace 2 by means of a hydraulic unit, etc., the sealing between them is secured.

(7) As measures for the exhaust gas and noise during an operation of the chemical, an exhaust gas processor such as a gas neutralizer or a dust arrester and a silencer (if necessary, an exhauster may be provided together) are provided in the downstream side of the exhaust tube 11.

Advantages of the Invention:

As described above, the inflator processing apparatus and the method of judging the timing of charge of inflators in accordance with the present invention give rise to the following advantages:

(1) Since the metal partition walls are provided between the inner surface of the furnace wall of the processing furnace and each inflator so as to cover the inner surface of the furnace wall, during an operation of the chemical, damage to the furnace wall refractories due to the inflators or their splashed fragments is prevented.

(2) Since the temperature of the high-temperature flame of the burner as a heating source of the inflators is adjusted by the ordinary-temperature air for dilution or/and the low-temperature exhaust gas, and the lower-temperature processing gas after the temperature adjustment is used for heating inflators softly and uniformly, the heating time up to an operation of the chemical is made uniform as well as the melting of the metal case of the inflator and the high-temperature oxidation of the metal partition walls of the processing furnace due to the processing gas are prevented.

(3) Since the timing of the intermittent charge of the inflators is determined by comparing the number of charged inflators with the number of peaks of the furnace pressure during an operation of the chemical, ejection of the processing gas out of the furnace due to the operation of the chemical is prevented during charge of the inflators. Therefore, not only the charging work is safe, but also the inflators can be subjected to heating and processing in a minimum time, thereby maximizing the performance of the processing apparatus.

What is claimed is:

1. An inflator processing apparatus comprising a processing furnace for processing inflators, said apparatus being configured to process a batch of gas generating chemical-containing automobile air bag inflators, each said inflator comprising a metal case, by heating the inflators to a temperature not lower than an explosion temperature of the chemical and subsequently recovering the metal cases of the inflators, wherein a metal partition wall composed of heat-resistant steel is provided, between the inflators and an inner surface of a ceramic wall of the processing furnace for processing the inflators, so as to cover the inner surface of the wall of the processing furnace and to prevent the inflators, when actuated by heating, from striking and damaging the inner surface of the ceramic wall of the processing furnace, said inflator processing apparatus further comprising a module for charging the apparatus with a batch of inflators, in which module a timing of charge of the batch of inflators is judged by comparing a total number of charged inflators located in the apparatus with an observed number of peak points of furnace pressure due to explosion of the chemical in the charged inflators located in the apparatus.

2. The inflator processing apparatus as claimed in claim 1, wherein an incinerator provided with a burner and an air supplier for dilution or/and an exhaust gas circulator is/are contiguous to and functionally connected with the processing furnace.

3. A method for determining the timing of charge of a batch of inflators into an inflator processing apparatus comprising a processing furnace, said apparatus being configured to process gas generating chemical-containing automobile air bag inflators by heating the inflators to a temperature not lower than an explosion temperature of the chemical and subsequently recovering the metal cases of the inflators, wherein a metal partition wall composed of heat-resistant steel is provided, between the inflators and the inner surface of a ceramic wall of the processing furnace for processing the inflators, so as to cover the inner surface of the wall of the processing furnace and to prevent an inflator actuated by heating from striking and damaging the inner surface of the ceramic wall of the processing furnace, which method comprises the step of comparing a total number of charged inflators located in the apparatus with an observed number of peak points of furnace pressure due to explosion of the chemical in the charged inflators located in the apparatus.

* * * * *